US010932543B2

(12) United States Patent
Lee

(10) Patent No.: US 10,932,543 B2
(45) Date of Patent: Mar. 2, 2021

(54) COSMETICS COMPACT CONTAINER HAVING DISCHARGE PLATE FOR EVENLY DISCHARGING COSMETICS

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 460 days.

(21) Appl. No.: 15/740,743

(22) PCT Filed: Jun. 28, 2016

(86) PCT No.: PCT/KR2016/006916
§ 371 (c)(1),
(2) Date: Dec. 28, 2017

(87) PCT Pub. No.: WO2017/010704
PCT Pub. Date: Jan. 19, 2017

(65) Prior Publication Data

US 2018/0184786 A1 Jul. 5, 2018

(30) Foreign Application Priority Data

Jul. 13, 2015 (KR) ..... 20-2015-0004712

(51) Int. Cl.
*A45D 40/00* (2006.01)
*A45D 33/02* (2006.01)
*B65D 83/00* (2006.01)

(52) U.S. Cl.
CPC ..... *A45D 40/0075* (2013.01); *A45D 33/025* (2013.01); *B65D 83/0033* (2013.01); *A45D 2200/054* (2013.01); *A45D 2200/056* (2013.01)

(58) Field of Classification Search
CPC ..... A45D 40/0075; A45D 2200/056; A45D 2200/054; A45D 33/02; A45D 33/025
(Continued)

(56) References Cited

U.S. PATENT DOCUMENTS 10,104,951 B2 * 10/2018 Lee ..... A45D 33/02
2016/0015149 A1 * 1/2016 Kim ..... A45D 33/008 222/383.1

FOREIGN PATENT DOCUMENTS

KR 20-0370307 Y1 12/2004
KR 10-0647455 B1 11/2006
(Continued)

*Primary Examiner* — Tatiana L Nobrega
*Assistant Examiner* — Sarah Woodhouse
(74) *Attorney, Agent, or Firm* — Heedong Chae; Lucem, PC

(57) ABSTRACT

The present invention includes a compact container, having a discharge plate and a distribution plate coupled by the discharge plate having a ring-shaped button member thereunder and the button member having rectangular pressure grooves on opposite sides of the inner circumferential surface, and the distribution plate-being provided under the button member, and the outer circumferential surface of the distribution plate having rectangular pressure protrusions, with arc-shaped tops, positioned so as to correspond to the rectangular pressure grooves of the button member. As such, when the button member is pressed to discharge cosmetics, even if the button member is pressed at an angle, the distribution plate can uniformly press a pump vertically as the rectangular pressure grooves of the button member shaped tops of the rectangular pressure protrusions on opposite sides of the distribution plate.

4 Claims, 11 Drawing Sheets

(58) Field of Classification Search
USPC ..... 132/299
See application file for complete search history.

(56) References Cited

FOREIGN PATENT DOCUMENTS

| | | | |
|---|---|---|---|
| KR | 20-0470757 | Y1 | 1/2014 |
| KR | 10-2014-0146982 | A | 12/2014 |
| KR | 20-2015-0002427 | U | 10/2015 |

* cited by examiner

--Prior Art--

--Prior Art--

--Prior Art--

COSMETICS COMPACT CONTAINER HAVING DISCHARGE PLATE FOR EVENLY DISCHARGING COSMETICS

CROSS-REFERENCE TO RELATED APPLICATION

This application claims the benefit of Korean application No. 20-2015-0004712, filed on Jul. 13, 2015 with the Korean Intellectual Property Office, the disclosure of which is incorporated herein by reference.

TECHNICAL FIELD

The present invention relates to a cosmetics compact container having a discharge plate for evenly discharging cosmetics, and more particularly, to a cosmetics compact container having a discharge plate for evenly discharging cosmetics, wherein a ring-shaped button member is formed below a discharge plate, rectangular pressure grooves are formed on both sides of an inner periphery of the button member, and a distribution plate is formed below the button member, in which rectangular pressure protrusions are formed on both sides of an outer periphery of the distribution plate so as to correspond to positions of the rectangular pressure grooves of the button member, such that the discharge plate is coupled to the distribution plate, thus when the button member is pressed to discharge the cosmetics, even if the button member is pressed in an inclined state, the rectangular pressure grooves of the button member press arc-shaped top portions formed on upper surfaces of the rectangular pressure protrusions formed on the both sides of the distribution plate, thereby enabling the distribution plate to uniformly press a pump in the vertical direction. In addition, a ring-shaped discharge channel is formed on an upper surface of the distribution plate, an outer discharge hole is formed outside the ring-shaped discharge channel, an inner discharge hole is formed inside the ring-shaped discharge channel, and the ring-shaped discharge channel is connected to a discharge passage formed at a center of the distribution plate, in which a control protrusion is formed in front of the outer discharge hole to prevent the cosmetics discharged from the discharge passage from being directly discharged to the outer discharge hole and the inner discharge hole, thereby evenly discharging the cosmetics to outlets formed in the discharge plate.

BACKGROUND ART

Color cosmetics, which are used to beautifully adorn the skin of a user by making the appearance beautiful, are classified into a base makeup used for making a skin color uniform and covering a defect and a point makeup used for partially enhancing a three-dimensional effect of a lip, eyes, or nails. The base makeup includes a makeup base, a foundation and a powder, and the point makeup includes a lipstick, an eye liner, and mascara.

The foundation is classified into solid-type foundation, liquid-type foundation and gel-type foundation according to a type of cosmetic contents. In case of the solid-type foundation, although the solid-type foundation has a good cover effect, the makeup is united when the makeup is refreshed. In case of the liquid-type foundation, although the liquid-type foundation gives a good close contact feel, the persistency is weak. Thus, in recent years, the number of customers who prefer the gel-type foundation, which has a considerable persistency and provides a good feeling when it is applied to the skin, has been increased.

Therefore, there is a need to develop a container for gel-type foundation. Generally, the gel-type foundation, which is filled into a glass container or a tube-type container, is used in such a manner that the user takes some foundation on user's hands for use or squeezes foundation from the container and then, applies the foundation on the user's skin by using a puff or user's hands.

However, according to the related art, since the user gets cosmetics on user's hand whenever using the cosmetics, it is inconvenient to wash hands every time after use. In addition, as the hands coated with cosmetics are washed, the cosmetics are wasted.

In order to solve the above problem, as shown in FIG. 1, the applicant of the present invention has filed Korean Utility Model Registration No. 20-0470757 to disclose a compact container having an airless pump, in which a distribution plate and a pump are pressed as a mixing member is pressed, thus gel cosmetics filled in a container body is discharged onto a discharge channel formed on an upper surface of the distribution plate, discharged through a plurality of outlets of a discharge plate provided on the distribution plate, and then impregnated into the mixing member formed on the discharge plate, thereby allowing a user to put the cosmetics impregnated in the mixing member on a puff for use, so that the cosmetics can be used without being put on hands when used.

According to the above related art, the pump is configured to be operated only when a piston center axis and a cylinder center axis match with each other, by tightly forming a gap between an up/down movement member and a bushing so as to induce the up/down movement member to vertically move.

However, when the user fails to push an exact middle of the mixing member upon operating the pump, as shown in FIG. 2, the up/down movement member is inclined and stuck in the bushing, thereby failing the operation.

Accordingly, when the user uses the cosmetic product, because the cosmetics are pumped only when the center of the mixing member is vertically pushed by using the puff, positions to be pressed are limited upon pressing the mixing member, thereby causing the inconvenience in use.

In addition, after the user uses the cosmetics, a large amount of the cosmetics remain in the discharge channel of the distribution plate, thus the cosmetics are volatilized or contaminated.

In order to solve the above problems, as shown in FIG. 3, according to the related art filed and being commercialized by the applicant of the present invention, a ring-shaped ring button member is provided below a discharge plate, grooves are formed on two opposite positions in a diagonal direction at the lower end of the ring button member, and a distribution plate is formed below the ring button member, in which protrusions are formed on outer sides of the distribution plate in a diagonally opposite direction so as to correspond to the positions of the grooves of the ring button member, such that the discharge plate is coupled to the distribution plate, thus when the ring button member is pressed to discharge the cosmetics, even if the ring button member is pressed in an inclined state, the grooves formed in the diagonal direction of the ring button member press upper portions of the protrusions of the distribution plate, so that the distribution plate can vertically press the pump, and cosmetics discharge channels are formed on the upper surface of the distribution plate and discharge protrusion wheels are formed on the lower surface of the discharge plate, so that the cosmetics can be evenly distributed throughout the entire discharge plate.

However, according to the above related art, when the ring button member is pressed to discharge the cosmetics, the groove formed in the ring button member is formed in a small semicircular shape, thus the distribution plate rarely presses the pump uniformly when an upper portion of the semi-cylindrical protrusion formed on the distribution plate is pressed.

In addition, the cosmetics discharged onto the distribution plate are moved along the straight cosmetics discharge channels and discharged to the outlets, such that the cosmetics are discharged in advance from the outlets positioned at a center and then discharged from the outer outlets, thus more cosmetics are discharged through the outlets positioned at the center and the cosmetics are rarely discharged evenly throughout the entire discharge plate, therefore the cosmetics are clotted when applied to the skin by using the puff.

DISCLOSURE

Technical Problem

To solve the above problems, the present invention provides a cosmetics compact container having a discharge plate for evenly discharging cosmetics, wherein a ring-shaped button member is formed below a discharge plate, rectangular pressure grooves are formed on both sides of an inner periphery of the button member, and a distribution plate is formed below the button member, in which rectangular pressure protrusions are formed on both sides of an outer periphery of the distribution plate so as to correspond to positions of the rectangular pressure grooves of the button member, so that the discharge plate is coupled to the distribution plate, thus when the button member is pressed to discharge the cosmetics, even if the button member is pressed in an inclined state, the rectangular pressure grooves of the button member press arc-shaped top portions formed on upper surfaces of the rectangular pressure protrusions formed on the both sides of the distribution plate, thereby enabling the distribution plate to vertically and uniformly press a pump.

In addition, the present invention provides a cosmetics compact container having a discharge plate for evenly discharging cosmetics, wherein a ring-shaped discharge channel is formed on an upper surface of the distribution plate, an outer discharge hole is formed outside the ring-shaped discharge channel, an inner discharge hole is formed inside the ring-shaped discharge channel, and the ring-shaped discharge channel is connected to a discharge passage formed at a center of the distribution plate, in which a control protrusion is formed in front of the outer discharge hole to prevent the cosmetics discharged from the discharge passage from being directly discharged to the outer discharge hole and the inner discharge hole, thereby evenly discharging the cosmetics to outlets formed in the discharge plate.

Technical Solution

The present invention provides a cosmetics compact container having a discharge plate for evenly discharging cosmetics, the cosmetics compact container including: a container body (10) having a space into which an inner container member (30) is inserted; a container lid (20) hinged to one side of the outer container (10) to be opened and closed; an inner container member (30) mounted inside the container body (10), accommodated therein with cosmetics, and mounted at a central upper portion thereof with a pump (33); a fixation member (40) fixed to an inner periphery of the container body (10) to fix the inner container member (30);

a distribution plate (50) coupled to an upper portion of the inner container member (30) and formed therein with a discharge channel (52) formed in a ring shape;

a discharge plate (60) coupled to an upper portion of the distribution plate (50) and formed therein with a plurality of outlets (62), wherein outer discharge holes (54) are formed at an outside of the discharge channel (52) of the distribution plate (50), inner discharge holes (56) are formed at an inside of the discharge channel (52), and a control protrusion (58) is formed in front of the outer discharge hole (54).

In addition, a discharge protrusion wheel (64) is formed at a lower side of the outlet (62) of the discharge plate (60), in which the discharge protrusion wheel (64) includes an outer discharge protrusion wheel (644) mounted in the outer discharge hole (54) of the distribution plate (50), and an inner discharge protrusion wheel (646) mounted in the inner discharge hole (56) of the distribution plate (50).

In addition, the outer discharge protrusion wheel (644) is opened toward a center of the discharge plate (60), and the inner discharge protrusion wheel (646) is opened toward an outside of the discharge plate (60).

In addition, a ring-shaped button member (70) is further provided on the distribution plate (50), wherein rectangular pressure grooves (75) are formed on both sides of an inner periphery of the button member (70) and rectangular pressure protrusions (55) having an arc-shaped top surface is formed on both sides of an outer periphery of the distribution plate (50) to correspond to positions of the rectangular pressure grooves (75).

In addition, the inner container member (30) includes an inner container (31), a pump support (32) coupled to an upper portion of the inner container (31), and a pump (33) installed at an upper center of the pump support (32).

Advantageous Effects

According to the present invention, there is provided with a cosmetics compact container having a discharge plate for evenly discharging cosmetics, wherein a ring-shaped button member is formed below a discharge plate, rectangular pressure grooves are formed on both sides of an inner periphery of the button member, and a distribution plate is formed below the button member, in which rectangular pressure protrusions are formed on both sides of an outer periphery of the distribution plate so as to correspond to positions of the rectangular pressure grooves of the button member, so that the discharge plate is coupled to the distribution plate, thus when the button member is pressed to discharge the cosmetics, even if the button member is pressed in an inclined state, the rectangular pressure grooves of the button member press arc-shaped top portions formed on upper surfaces of the rectangular pressure protrusions formed on the both sides of the distribution plate, such that the distribution plate can vertically and uniformly press a pump.

In addition, there is provided with a cosmetics compact container having a discharge plate for evenly discharging cosmetics, wherein a ring-shaped discharge channel is formed on an upper surface of the distribution plate, an outer discharge hole is formed outside the ring-shaped discharge channel, an inner discharge hole is formed inside the ring-shaped discharge channel, and the ring-shaped discharge channel is connected to a discharge passage formed at a center of the distribution plate, in which a control protrusion is formed in front of the outer discharge hole to prevent the cosmetics discharged from the discharge passage from being directly discharged to the outer discharge hole and the inner discharge hole, such that the cosmetics can be evenly discharged to the outlets formed in the discharge plate.

BEST MODE

Mode for Invention

Embodiments of a cosmetics compact container having a discharge plate for evenly discharging cosmetics according to the present invention will be described with reference to the accompanying drawings.

Figure 1:
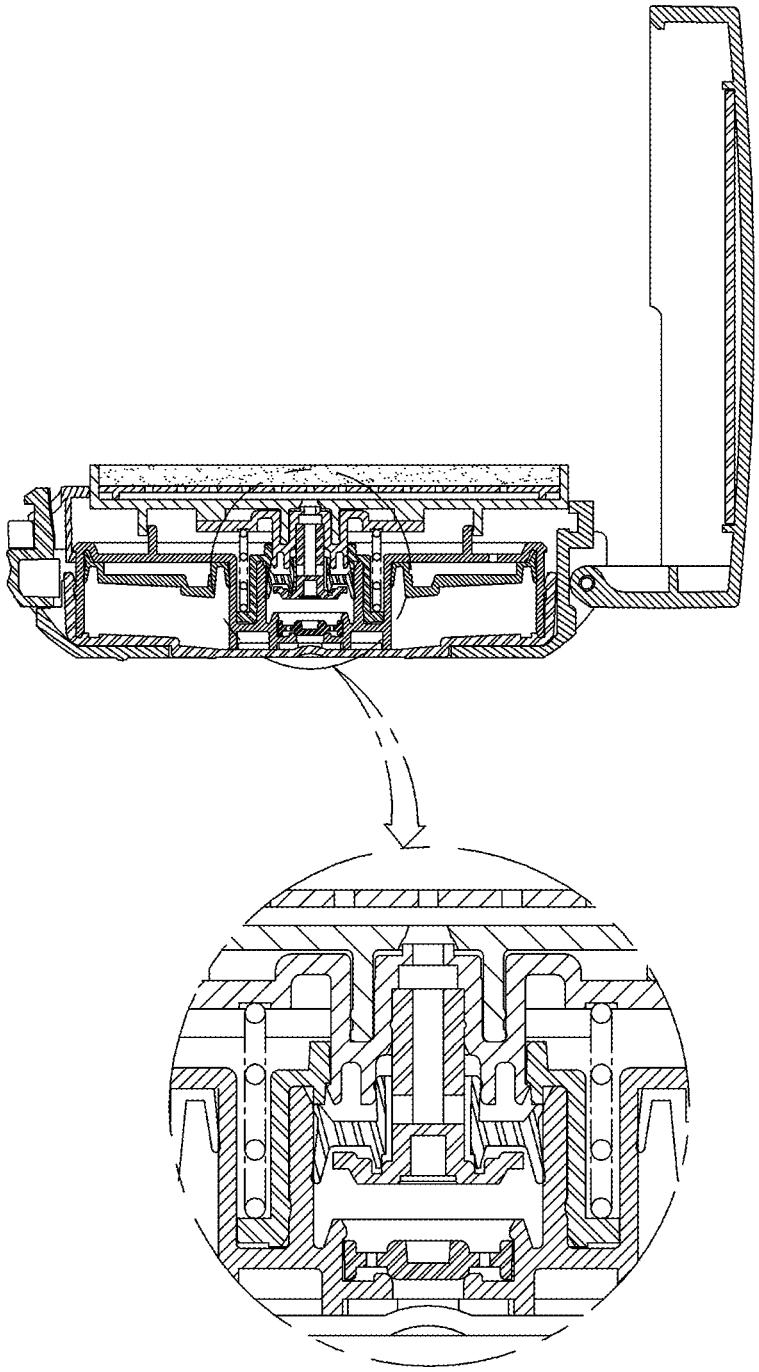
FIG. 1 is a sectional view showing a conventional compact container having an airless pump.
Figure 2:
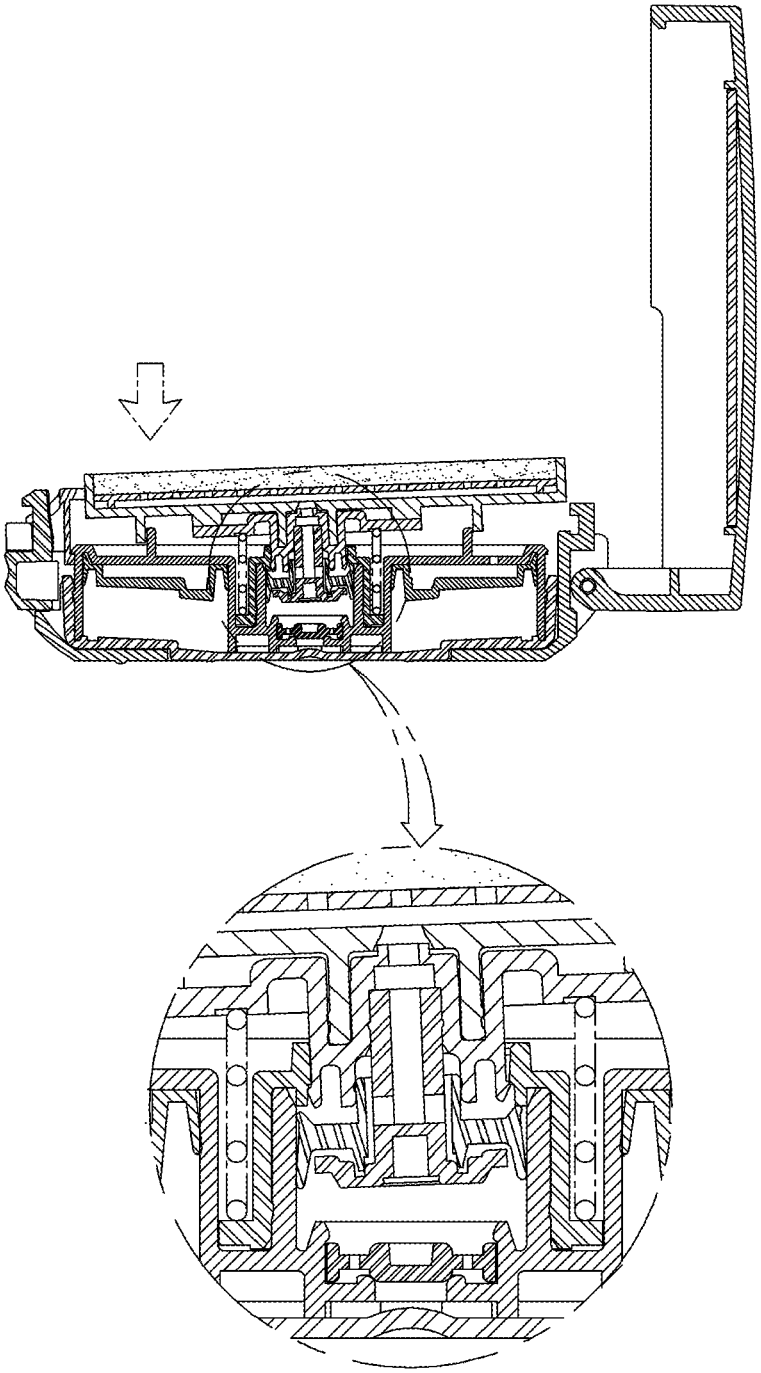
FIG. 2 is a sectional view showing a state of pressing a mixing member of a conventional compact container having an airless pump.
Figure 3:
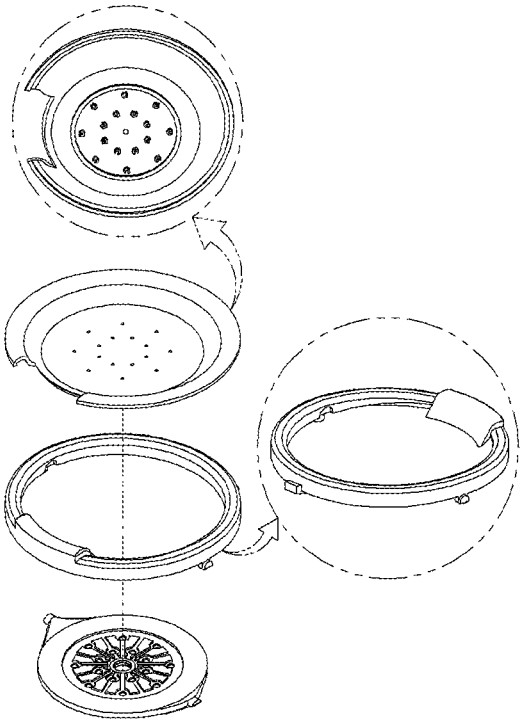
FIG. 3 is an exploded perspective view showing a conventional compact container having a ring button member.
Figure 4:
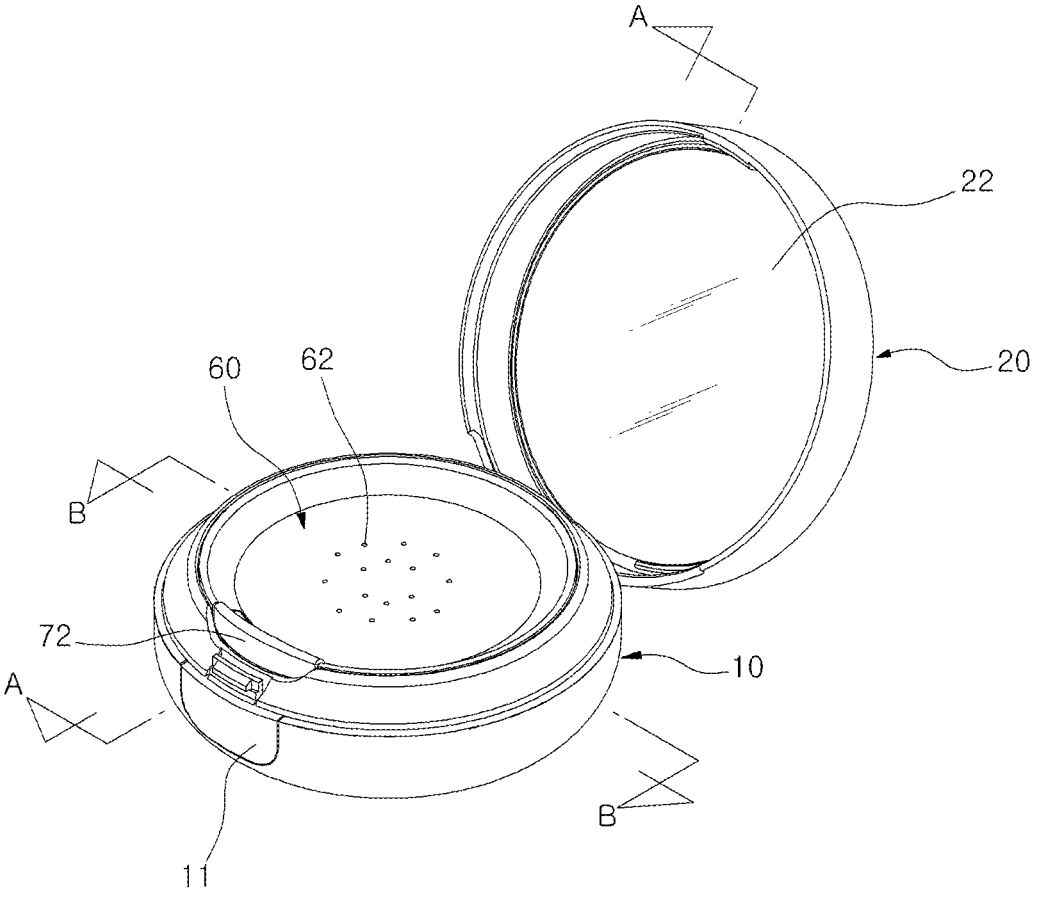
FIG. 4 is a perspective view showing a cosmetics compact container having a discharge plate for evenly discharging cosmetics according to the present invention.
Figure 5:
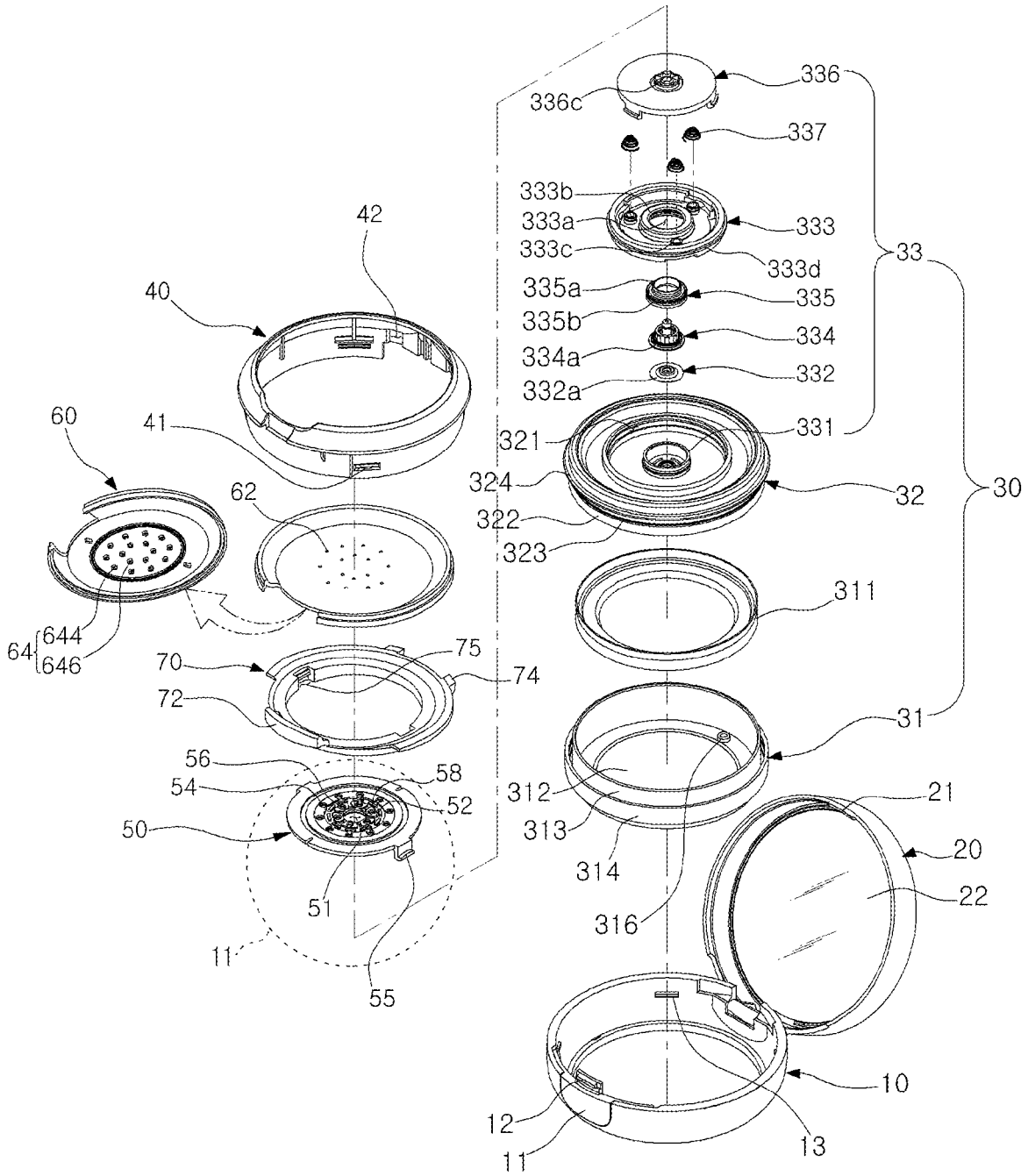
FIG. 5 is an exploded perspective view showing a cosmetics compact container having a discharge plate for evenly discharging cosmetics according to the present invention.
Figure 6:
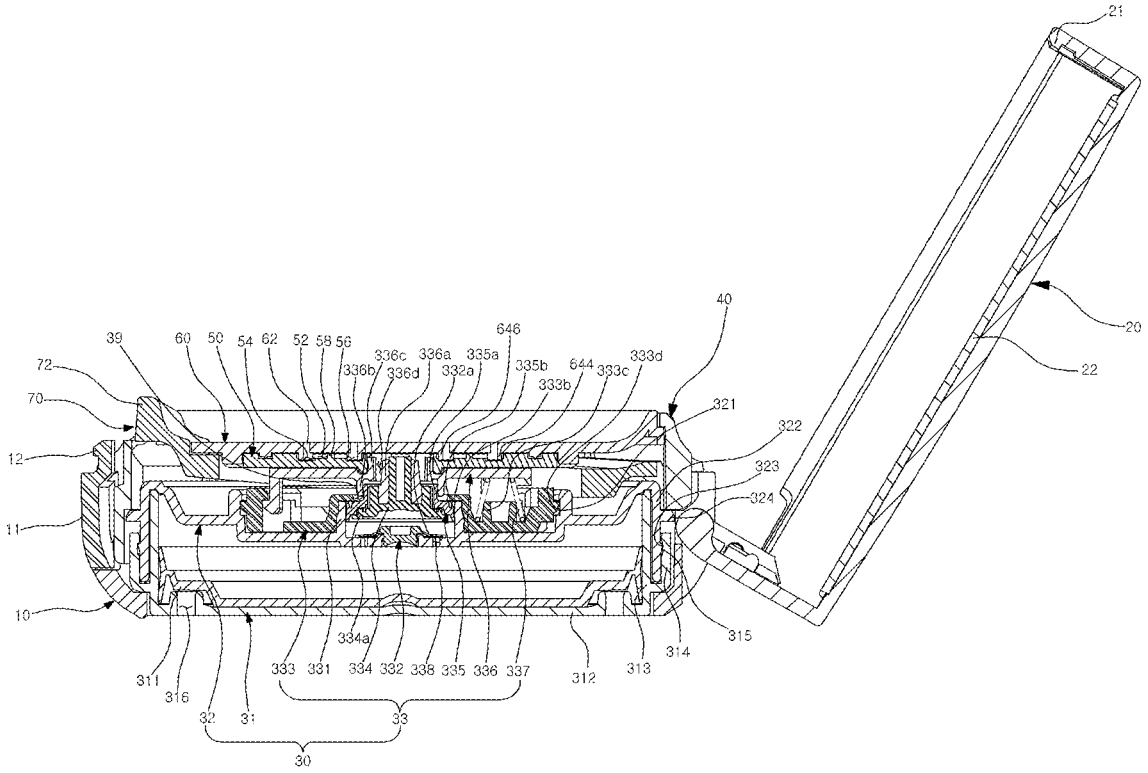
FIG. 6 is a sectional view taken along the line A-A of a cosmetics compact container having a discharge plate for evenly discharging cosmetics according to the present invention.
Figure 7:
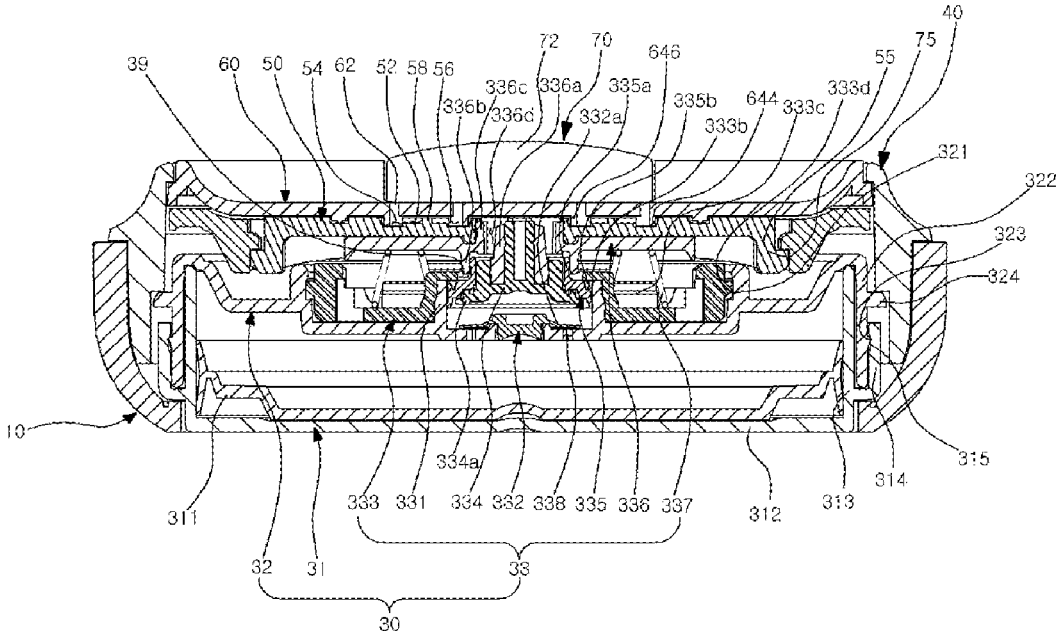
FIG. 7 is a sectional view taken along the line B-B of a cosmetics compact container having a discharge plate for evenly discharging cosmetics according to the present invention.

FIG. 4 is a perspective view showing a cosmetics compact container having a discharge plate for evenly discharging cosmetics according to the present invention. FIG. 5 is an exploded perspective view showing a cosmetics compact container having a discharge plate for evenly discharging cosmetics according to the present invention. FIG. 6 is a sectional view taken along the line A-A of a cosmetics compact container having a discharge plate for evenly discharging cosmetics according to the present invention. FIG. 7 is a sectional view taken along the line B-B of a cosmetics compact container having a discharge plate for evenly discharging cosmetics according to the present invention.

According to the present invention, the cosmetics compact container having the discharge plate for evenly discharging cosmetics includes: a container body 10 having a space into which an inner container member 30 is inserted; a container lid 20 hinged to one side of the outer container 10 to be opened and closed; an inner container member 30 mounted inside the container body 10, accommodated therein with cosmetics, and mounted at a central upper portion thereof with a pump 33; a fixation member 40 fixed to an inner periphery of the container body 10 to fix the inner container member 30;

a distribution plate 50 coupled to an upper portion of the inner container member 30 and formed therein with a discharge channel 52 formed in a ring shape; a discharge plate 60 coupled to an upper portion of the distribution plate 50 and formed therein with a plurality of outlets 62, wherein outer discharge holes 54 are formed at an outside of the discharge channel 52 of the distribution plate 50, inner discharge holes 56 are formed at an inside of the discharge channel 52, and a control protrusion 58 is formed in front of the outer discharge hole 54.

An inner container member 30 is accommodated in the container body 10, a button 11 is mounted on the container body 10, and a latching protrusion 12 protrudes from an upper portion of the button 11.

A mount protrusion 13 is formed on an inner side surface of the container body 10 so as to be coupled to a fixation member 40.

The container lid 20 is hinged to one side of the container body 10 to open and close the container body 10.

A protrusion-shaped hook 21 is formed on a position corresponding to the button 11 of the container body 10 at one side of the container lid 20 so as to be fastened to the latching protrusion 12 of the button 11.

A mirror 22 is provided on an inner side of the container lid 20 so that the user can easily put makeup.

The inner container member 30 includes an inner container 31, a pump support 32 coupled to an upper portion of the inner container 31, and a pump 33 installed at an upper center of the pump support 32.

The inner container 31 is inserted into the container body 10, and the cosmetics are accommodated in the inner container 31.

The inner container 31 is provided therein with a pushing plate 311 for pushing the contents upward, and the pushing plate 311 comes in close contact with an inner surface of the inner container 31.

The inner container 31 includes a bottom surface 312, an inner wall 313 extending upward from the bottom surface 312, and an outer wall 314 spaced apart outwardly from the inner wall 313 at a predetermined interval.

A fastening groove 315 is formed on an inner periphery of the outer wall 314 of the inner container 31 so as to be coupled to the pump support 32.

The bottom surface 312 of the inner container 31 is formed therein with an air flow hole 316 into which external air introduced.

The pump support 32 is formed in a plate shape and coupled to an upper portion of the inner container 31, thereby sealing the inner container 31.

A cylinder 331 is integrally formed at a center of the pump support 32, a bushing coupling groove 321, which a bushing 333 of the pump 33 is coupled to, is formed at the outside of the cylinder 331, and a lower extension protrusion wheel 322 extends downward from an outer side of the pump support 32.

A fastening protrusion 323 is formed on an outer periphery of the lower extension protrusion wheel 322 of the pump support 32 so as to be coupled to the fastening groove 315 of the inner container 31, and a step 324 protrudes from an upper side of the fastening protrusion 323.

The pump 33 includes: the cylinder 331 formed at a central upper side of the pump support 32 and formed in a bottom surface thereof with a contents suction hole 338; a suction valve plate 332 mounted on the bottom surface of the cylinder 331 to selectively open/close the contents suction hole 338; a bushing 333 coupled to an outer side of the cylinder 331 so as to be put on an upper end of the cylinder 331; a piston 334 formed inside the cylinder 331; a piston ring 335 fitted to an outer side of the piston 335 and coming in close contact with an inner surface of the cylinder 331; an up/down movement member 336 coupled to an upper portion of the piston 334 to move up and down; and an elastic member 337 for elastically supporting the up/down movement member 336.

An inner extension protrusion wheel 336*a* coupled to the piston 334 extends from a lower center of the up/down movement member 336, and an outer extension protrusion wheel 336*b* spaced apart from an outer side of the inner extension protrusion wheel 336*a* at a predetermined interval and fitted to an outer side of the piston ring 335.

In addition, an upper extension protrusion wheel 336*c* coupled to the distribution plate 50 extends from an upper center of the up/down movement member 336.

A plurality of discharge paths 336*d* through which the pumped contents pass are formed between the inner extended protrusion wheel 336*a* and the outer extended protrusion wheel 336*b* of the up/down movement member 336.

An upper portion of the piston ring 335 is opened outwardly, a close contact protrusion wheel 335*a* protrudes from an outer periphery of the upper portion of the piston ring 335, and a piston blade 335*b* coming in close contact with the inner wall of the cylinder 331 is formed below the close contact protrusion wheel 335*a*.

A through hole 333*a* through which the outer extension protrusion wheel 336*b* of the up/down movement member 336 passes is formed at a center of the bushing 333, an inner horizontal extension piece 333*b* extends inside the through hole 333*a*, a plurality of elastic member mounting parts 333*c* are formed outside the through hole 333*a*, and an outer horizontal extension piece 333*d* fitted to the pump support 32 is formed outside the elastic member mounting part 333*c*.

Preferably, an inner end of the inner horizontal extension piece 333*b* of the bushing 333 is formed in a round shape.

A gap 39 in the range of 0.3 mm to 1.2 mm is formed between the inner horizontal extension piece 333*b* of the bushing 333 and the outer extension protrusion wheel 336*b* of the up/down movement member 336 so that the up/down movement member 336 may freely move in the bushing 333.

In other words, the upper portion of the piston ring 335 is opened outward and having the close contact protrusion wheel 335*a*, thereby coming close contact with and being fitted to the inner side of the outer extension protrusion wheel 336*b* of the up/down movement member 336. In addition, the piston blade 335*b* is formed at the lower portion of the piston ring 335, thereby coming in close contact with the inner surface of the cylinder 331, such that the inside of the cylinder 331 is sealed by the piston ring 335, thus the pump 33 is normally operated even if the up/down movement member 336 is pressed in a state that the up/down movement member 336 is inclined to one direction.

Accordingly, even if the up/down movement member 336 is inclined as the user presses a portion deviating from a center of the discharge plate 70 without vertically pressing the center of the discharge plate 70, the piston ring 335 is normally operated inside the cylinder 331, so that the contents may be easily pumped.

The fixation member 40 is coupled to the upper portion of the inner container member 30 to fix the inner container member 30, the distribution plate 50, the discharge plate 60, and the button member 70 such that the inner container member 30, the distribution plate 50, the discharge plate 60, and the button member 70 can be prevented from being separated.

The mount groove 41 is formed on the outer periphery of the fixation member 40 so as to be coupled to the mount protrusion 13 of the container body 10.

The lower end of the fixation member 40 presses and fixes an upper surface of the step 324 of the pump support 32, and an axis coupling groove 42 is formed on one side of an outer periphery of the fixation member 40 so that the button member 70 is inserted.

The distribution plate 50 is mounted on the upper portion of the inner container member 30, thereby moving the cosmetics pumped by the pump 33.

The distribution plate 50 is formed at the center thereof with a discharge passage 51 through which the cosmetics pumped by the pump 33 is discharged, and the upper extension protrusion wheel 336*c* of the up/down movement member 336 is inserted into the discharge passage 51 from below.

A ring-shaped discharge channel 52 is formed on the upper surface of the distribution plate 50, in which the discharge channel 52 communicates with the discharge passage 51, an outer discharge hole 54 is formed on the outside of the discharge channel 52, and an inner discharge hole 56 is formed on the inside of the discharge channel 52.

A control protrusion 58 is formed in front of the outer discharge hole 54 to prevent the cosmetics discharged from the discharge passage 51 from being directly discharged to the outer discharge hole 54 and the inner discharge hole 56.

In other words, the cosmetics discharged from the discharge passage 51 move through the discharge channel 52, in which a part of the cosmetics passes between the control protrusions 58 and moves to the outer discharge hole 54, and the remaining part collides with the control protrusions 58 so as to move to the inner discharge hole 56, thereby enabling the cosmetics to be uniformly discharged to the entire outlets 62 of the discharge plate 60 while being dispersed inward and outward.

Further, because a plurality of control protrusions are formed in the discharge channel, the area of the discharge channel 52 is reduced, thereby reducing residues of the cosmetics remaining in the discharge channel 52.

In addition, the distribution plate 50 is preferably attached to the lower surface of the discharge plate 60 by using a double adhesive tape.

The ring-shaped button member 70 is further provided on the distribution plate 50, in which rectangular pressure grooves 75 are formed on both sides of an inner periphery of the button member 70, and rectangular pressure protrusions 55 having an arc-shaped top surface are formed on both sides of an outer periphery of the distribution plate 50 to correspond to positions of the rectangular pressure grooves 75.

In other words, when user presses the button member 70 to discharge the cosmetics, even if the button member 70 is pressed in an inclined state, the rectangular pressure grooves 75 of the button member 70 vertically press the distribution plate 50 while sliding to arc-shaped top surfaces formed on upper surfaces of the rectangular pressure protrusions 55, thereby enabling the distribution plate 50 to uniformly press a pump 33.

In addition, a pressing part 72 protrudes upward from one side of the button member 70, and an axis protrusion 74 inserted into an axis coupling groove 42 of the fixation member 40 is formed on an outer opposite side of the pressing part 72.

The discharge plate 60 is mounted on the distribution plate 50 and the button member 70, and has a plurality of outlets 62.

A discharge protrusion wheel 64 is formed at a lower side of the outlet 62 of the discharge plate 60, in which the discharge protrusion wheel 64 includes an outer discharge protrusion wheel 644 mounted in the outer discharge hole 54 of the distribution plate 50, and an inner discharge protrusion wheel 646 mounted in the inner discharge hole 56 of the distribution plate 50.

The outer discharge protrusion wheel 644 is opened toward a center of the discharge plate 60, and the inner discharge protrusion wheel 646 is opened toward an outside of the discharge plate 60.

A method of assembling the cosmetics compact container having the discharge plate for evenly discharging the cosmetics configured in the above manner will be described as follows.

In order to assemble the cosmetics compact container having the discharge plate for evenly discharging the cosmetics according to the present invention, as shown in FIGS. 5 and 6, the container member 30 is assembled first, in which the pushing plate 311 is inserted into the inner container 31, the cosmetics are injected into the inner container 31, the pump support 32 is coupled to the upper portion of the inner container 31, and the pump 33 is installed on the upper portion of the pump support 32.

Next, the inner container member 30 assembled in the above manner is inserted into the container body 10 having one side hinged to the container lid 20.

Next, the distribution plate 50 is coupled to the upper portion of the up/down movement member 336 of the pump 33, in which the upper extension protrusion wheel 336*c* of the up/down movement member 336 is inserted into the discharge passage 51 of the distribution plate 50.

Next, the ring-shaped button member 70 is mounted on the distribution plate 50, in which the rectangular pressure protrusions 55 of the distribution plate 50 are fitted into the rectangular pressure grooves 75 of the button member 70.

Next, the discharge plate 60 is mounted on the distribution plate 50 and the button member 70, in which the outer discharge protrusion wheel 644 and the inner discharge protrusion wheel 646 of the discharge plate 60 are mounted in the outer discharge hole 54 and the inner discharge hole 56 of the distribution plate 50, respectively.

Finally, the fixation member 40 is coupled to on the upper portion of the discharge plate 60, in which the mount protrusion 13 of the container body 10 is coupled to the mount groove 41 of the fixation member 40, and the axis protrusion 74 of the button member 70 is fitted into the axis coupling groove 42 of the fixation member 40, thereby finishing the assembly the cosmetics compact container having the discharge plate for evenly discharging the cosmetics according to the present invention.

A method of using the above assembled cosmetics compact container having the discharge plate for evenly discharging the cosmetics will be described with reference to the accompanying drawings.

Figure 8:
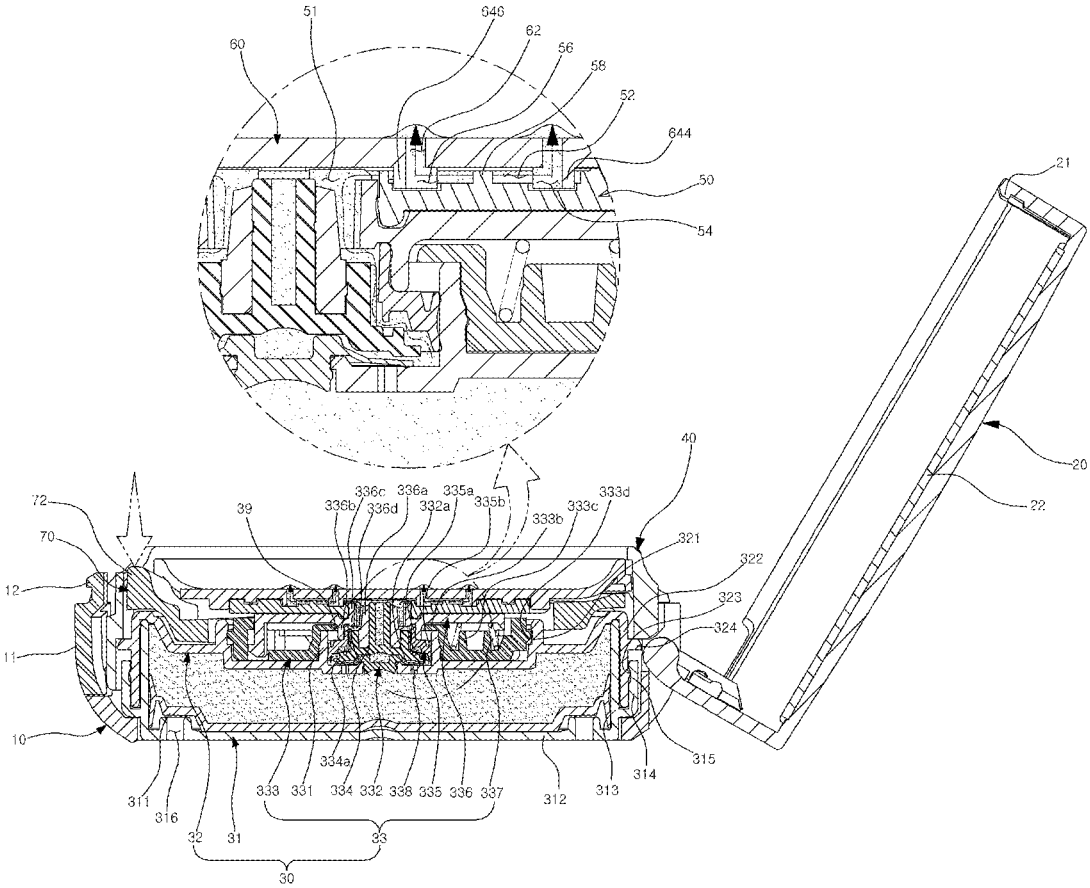
FIG. 8 is a sectional view taken along the line A-A and showing a state of pressing a button member of a cosmetics compact container having a discharge plate for evenly discharging cosmetics according to the present invention.
Figure 9:
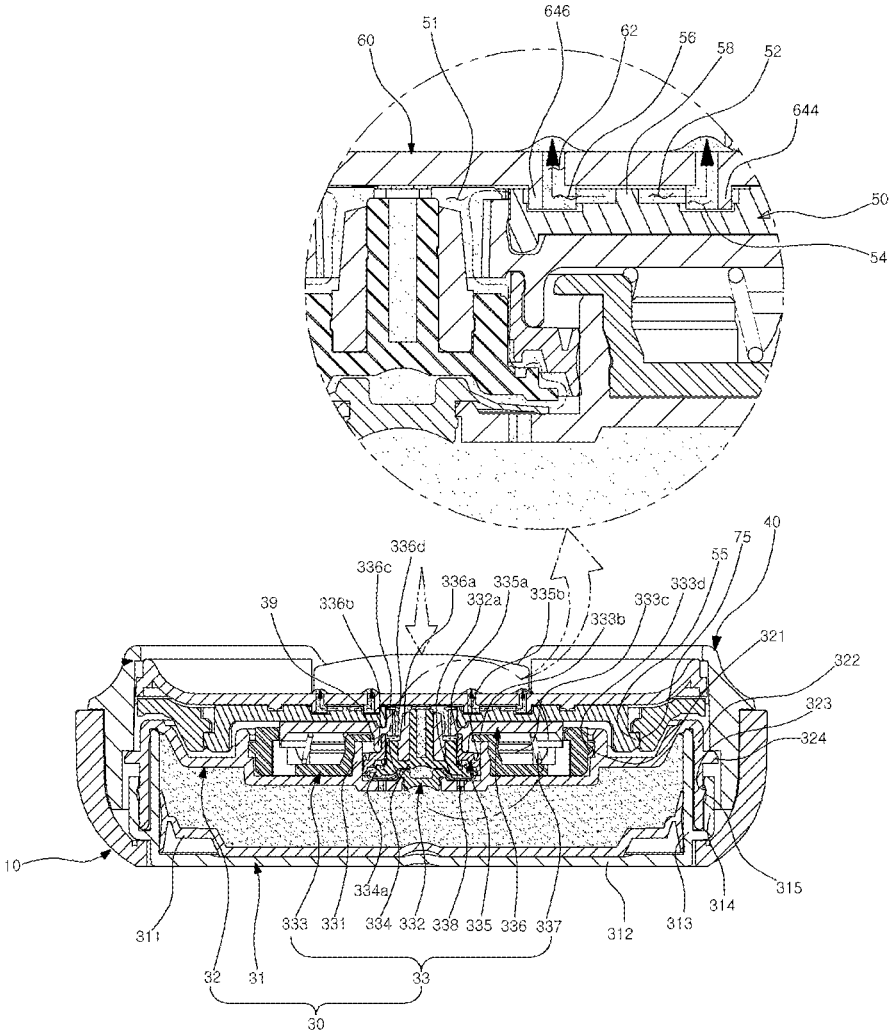
FIG. 9 is a sectional view taken along the line B-B and showing a state of pressing a button member of a cosmetics compact container having a discharge plate for evenly discharging cosmetics according to the present invention.
Figure 10:
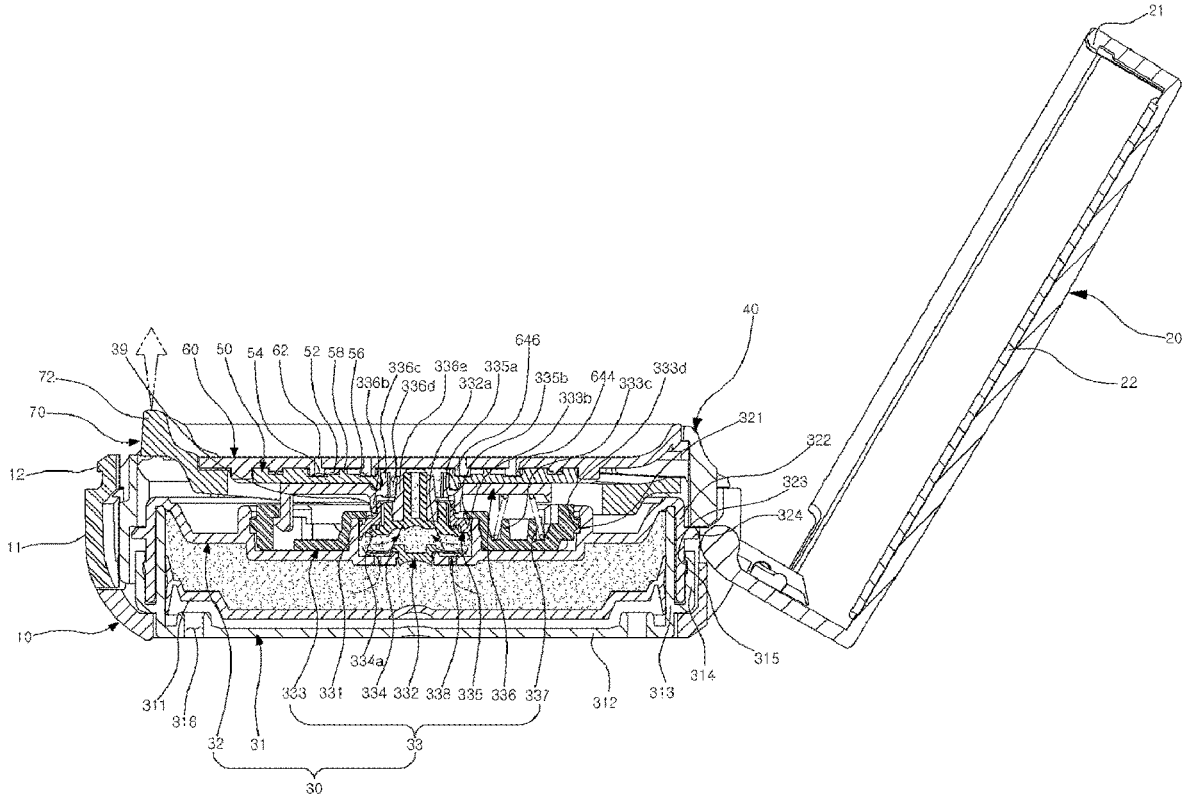
FIG. 10 is a sectional view taken along the line A-A and showing a state of releasing the pressing a button member of a cosmetics compact container having a discharge plate for evenly discharging cosmetics according to the present invention.
Figure 11:
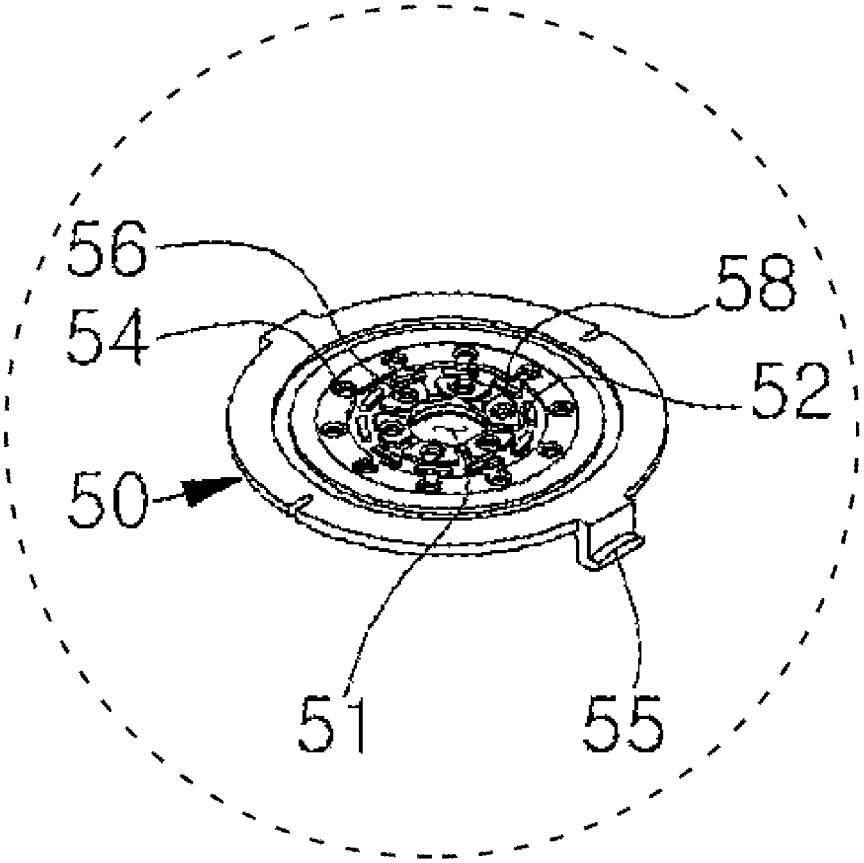
FIG. 11 is an enlarged view of a distribution plate of the cosmetics compact container shown in FIG. 5.

FIG. 8 is a sectional view taken along the line A-A and showing a state of pressing a button member of a cosmetics compact container having a discharge plate for evenly discharging cosmetics according to the present invention. FIG. 9 is a sectional view taken along the line B-B and showing a state of pressing a button member of a cosmetics compact container having a discharge plate for evenly discharging cosmetics according to the present invention. FIG. 10 is a sectional view taken along the line A-A and showing a state of releasing the pressing a button member of a cosmetics compact container having a discharge plate for evenly discharging cosmetics according to the present invention.

In order to use the cosmetics compact container having the discharge plate for evenly discharging the cosmetics according to the present invention, first, the container lid 20 is opened from the container body 10 by pressing the button 11.

Next, as shown in FIG. 8, the pressing part 72 of the button member 70 or the upper surface of the discharge plate 60 is pressed.

When the pressing part 72 is pressed, the button member 70 moves downward while being inclined, and the distribution plate 50 mounted below the button member 70 also moves downward.

At this point, even if the button member 70 is pressed in an inclined state, the rectangular pressure grooves 75 of the button member 70 vertically press the distribution plate 50 while sliding to arc-shaped top surfaces formed on upper surfaces of the rectangular pressure protrusions 55, thereby the distribution plate 50 can uniformly press the pump 33.

In addition, when the discharge plate 60 is directly pressed, the distribution plate 50 coupled to the discharge plate 60 is pressed and moves downward together, and the up/down movement member 336 of the pump 33 coupled to the distribution plate 50 moves downward.

The piston 334 coupled to the lower side of the up/down movement member 336 also moves downward due to the downward movement of the up/down movement member 336, in which the piston ring 335 comes in close contact with the inner surface of the cylinder 331, thus only the piston 334 moves downward to generate a gap between the piston 334 and the piston ring 335, so that the discharge passage for the cosmetics is generated.

Then, when the up/down movement member 336 is continuously pressed, as shown in FIGS. 8 and 9, the piston ring 335 comes in contact with the up/down movement member 336 to move downward together with the piston 334, thereby reducing the volume inside the cylinder 331, thus the cosmetics accommodated in the cylinder 331 flow out between the piston 334 and the piston ring 335, pass through the discharge paths 336*d* of the up/down movement member 336, pass through the discharge passage 51 and the discharge channel 52 of the distribution plate 50, and is discharged to the outlets 62 of the discharge plate 60.

Herein, a part of the cosmetics passes between the control protrusions 58 of the distribution plate 50 and moves to the outer discharge hole 54, and the remaining part collides with the control protrusions 58 of the distribution plate 50 so as to be moved and dispersed to the inner discharge hole 56, thereby being uniformly discharged to the entire outlets 62 of the discharge plate 60.

Simultaneously, the suction valve plate 332 closes the contents suction hole 338 formed on the bottom surface of the cylinder 331 caused by discharge pressure in the cylinder 331.

Then, as shown in FIG. 10, when the pressure against the pressing part 72 of the button member 70 or the discharge plate 60 is released, the up/down movement member 336 moves upward due to the elasticity of the elastic member 337 which elastically supports the up/down movement member 336, and the piston 334 coupled to the lower portion of the up/down movement member 336 moves upward, in which an extension protrusion wheel 334*a* formed on an outer side of the lower end of the piston 334 lifts the piston ring 335 upward, thereby blocking the gap between the piston 334 and the piston ring 335, such that the piston 334 moves upward together with the piston ring 335, thus the volume inside the cylinder 331 increases, therefore vacuum pressure is generated.

The suction valve blade 332*a* of the suction valve plate 332 is lifted by the vacuum pressure generated in the cylinder 331, thereby opening the contents suction hole 338 formed on the bottom surface of the cylinder 331, thus the cosmetics accommodated in the inner container 31 is introduced into the cylinder 331 through the contents suction hole 338, and simultaneously the pushing plate 311 installed inside the inner container 31 moves upward.

The aforementioned description is just one embodiment for carrying out a cosmetics compact container having a discharge plate for evenly discharging cosmetics, and the present invention is not limited thereto, and it will be apparent to those having ordinary skill in the art in that various substitutions, deformations and modifications are available within the scope without departing from the invention.

REFERENCE NUMERALS

| | |
|---|---|
| 10: container body | 11: button |
| 20: case lid | 30: inner container member |
| 31: inner container | 32: pump support |
| 33: pump | 40: fixation member |
| 42: axis coupling groove | 50: distribution plate |
| 51: discharge passage | 52: discharge channel |
| 54: outer discharge hole | |
| 55: rectangular pressure protrusion | |
| 56: inner discharge hole | 58: control protrusion |
| 60: discharge plate | 62: outlet |
| 64: discharge protrusion wheel | 70: button member |
| 74: axis protrusion | 75: rectangular pressure groove |
| 644: outer discharge protrusion wheel | |
| 646: inner discharge protrusion wheel | |

The invention claimed is:

1. A cosmetics compact container comprising:

a container body (10) formed therein with a space;

an inner container member (30) for housing a cosmetic, wherein the inner container member (30) comprises an inner container (31), a pump support (32) coupled to an upper portion of the inner container (31), and a pump (33) installed at an upper central portion of the pump support (32);

a fixation member (40) positioned on an inner periphery of the container body (10), wherein the fixation member couples the inner container member (30) to the container body;

a container lid (20) hinged to one side of the container body (10) and configured to be opened and closed;

a ring-shaped button member (70) comprising pressure grooves (75) positioned on an inner periphery thereof;

a distribution plate (50) coupled to an upper portion of the pump (33), comprising:

a central discharge passage (51) communicatively coupled to the pump, a ring-shaped discharge channel (52) positioned concentrically about the central discharge passage and communicatively coupled thereto, a plurality of inner discharge holes (56) evenly spaced within the ring-shaped discharge channel (52), a plurality of outer discharge holes (54) evenly spaced and arranged in a circular array completely surrounding the ring-shaped discharge channel (52), a plurality of control protrusions (58) positioned in a circular array within the ring-shaped discharge channel, wherein the plurality of control protrusions are positioned radially between the plurality of inner discharge holes and the plurality of outer discharge holes, and pressure protrusions (55) formed on an outer periphery of the distribution plate and positioned to correspond to the pressure grooves (75) of the ring-shaped button member; and a discharge plate (60) coupled to an upper portion of the distribution plate (50), and formed therein with a plurality of outlets (62), the ring-shaped button member (70) is positioned at an upper surface of the distribution plate (50) wherein during use, the ring-shaped button member (70) is pressed such that the pressure grooves (75) press an upper surface of the pressure protrusions (55) causing the distribution plate (50) to press the pump (33), thereby discharging the cosmetic through the distribution plate (50) and the discharge plate (60).

2. The cosmetic compact container of claim 1, wherein a discharge protrusion (64) is formed at a lower side of discharge plate (60) in fluid communication with the plurality of outlets (62), the discharge protrusion (64) includes a plurality of outer discharge protrusions (644) mounted in the plurality of outer discharge holes (54) of the distribution plate (50), and plurality of inner discharge protrusions (646) mounted in the plurality of inner discharge holes (56) of the distribution plate (50).

3. The cosmetic compact container of claim 2, wherein the plurality of outer discharge holes (54) each have an opening oriented toward a center of the discharge plate (60), and the plurality of inner discharge holes each have an opening oriented toward an outside of the discharge plate (60), wherein during use, the cosmetics discharged from the pump enter the distribution plate (50) through the central discharge passage (51) and are moved through the discharge channel, directed by the plurality of control protrusions (58) such that a portion of the cosmetic is directed toward the plurality of outer discharge holes (54) and a portion of the cosmetic is directed toward the plurality of inner discharge holes (56), thereby uniformly distributing the cosmetics to the discharge plate via the plurality of inner and outer discharge protrusions.

4. The cosmetic compact container of claim 1, wherein the pressure grooves (75) are rectangular, and the pressure protrusions (55) are rectangular with an arc-shaped top surface to correspond to positions of the rectangular pressure grooves (75).

* * * * *